US010064457B2

(12) United States Patent
Shah

(10) Patent No.: US 10,064,457 B2
(45) Date of Patent: Sep. 4, 2018

(54) METAL ONE PIECE LOCKING SLIDE AND PULL FOR SLIDE FASTENER

(71) Applicant: Shah Technologies LLC, Palm Beach Gardens, FL (US)

(72) Inventor: Nirav Ashok Shah, Mumbai (IN)

(73) Assignee: Shah Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 15/385,294

(22) Filed: Dec. 20, 2016

(65) Prior Publication Data

US 2018/0168292 A1 Jun. 21, 2018

Related U.S. Application Data

(63) Continuation-in-part of application No. 15/385,000, filed on Dec. 20, 2016.

(51) Int. Cl.

| | |
|---|---|
| ***A44B 19/30*** | (2006.01) |
| ***A44B 19/26*** | (2006.01) |
| ***A44B 19/42*** | (2006.01) |
| ***B21D 53/52*** | (2006.01) |

(52) U.S. Cl.

CPC ..... *A44B 19/306* (2013.01); *A44B 19/262* (2013.01); *A44B 19/42* (2013.01); *B21D 53/52* (2013.01)

(58) Field of Classification Search

CPC ..... A44B 19/26; A44B 19/262; A44B 19/42; A44B 19/306; B21D 58/52; B21D 58/54

See application file for complete search history.

(56) References Cited

U.S. PATENT DOCUMENTS

| | | | | |
|---|---|---|---|---|
| 2,509,278 A | | 5/1950 | Scheuermann et al. | |
| 2,736,062 A | | 2/1956 | Scheuermann et al. | |
| 3,018,534 A | * | 1/1962 | Huelster | A44B 19/305 24/419 |
| 3,225,405 A | * | 12/1965 | Moser | A44B 19/30 24/423 |
| 3,320,645 A | * | 5/1967 | Burbank | A44B 19/30 24/421 |
| 3,793,684 A | * | 2/1974 | Moertel | A44B 19/26 24/421 |

(Continued)

FOREIGN PATENT DOCUMENTS

| | | |
|---|---|---|
| CN | 2167578 Y | 1/1990 |
| CN | 1338370 A | 3/2002 |

(Continued)

OTHER PUBLICATIONS

Anonymous, "How die casting machine produce zipper slider", Internet article retrieved Jun. 14, 2016, http://www.kinghuamc.com/how-die-casting-machine-produce-zipper-slider/,(2016).

*Primary Examiner* — David M Upchurch
(74) *Attorney, Agent, or Firm* — McHale & Slavin, P.A.

(57) ABSTRACT

The device provides a locking slide assembly for a zipper, and a method for manufacturing a locking zipper slide assembly. The locking slider assembly is formed in a single die cast operation to include the locking slider and the pull member being formed simultaneously. Whereby the bridge and pull loop are formed with their full geometric shape and without converging flat surfaces caused by tooling limitations found in the prior art.

16 Claims, 7 Drawing Sheets

(56) References Cited

U.S. PATENT DOCUMENTS 3,813,736 A * 6/1974 Fukuroi ..... A44B 19/308 24/424
4,081,883 A * 4/1978 Ishii ..... A44B 19/306 24/421
4,102,022 A * 7/1978 Aoki ..... A44B 19/308 24/421
4,123,828 A * 11/1978 Akashi ..... A44B 19/308 24/422
4,210,196 A 7/1980 Weiner
4,287,646 A * 9/1981 Kanzaka ..... A44B 19/308 24/424
4,644,613 A * 2/1987 Kedzierski ..... A44B 19/306 24/420
4,679,281 A * 7/1987 Ishii ..... A44B 19/308 24/419
4,719,673 A * 1/1988 Kubo ..... A44B 19/30 24/419
4,768,263 A * 9/1988 Fukuroi ..... A44B 19/306 24/418
4,790,973 A 12/1988 Minami et al.
4,976,014 A * 12/1990 Akashi ..... A44B 19/306 24/421
4,985,969 A 1/1991 Terada et al.
5,013,511 A 5/1991 Akashi
5,152,036 A * 10/1992 Oda ..... A44B 19/308 24/421
5,419,019 A * 5/1995 Ida ..... A44B 19/306 24/421
5,544,394 A * 8/1996 Yaguramaki ..... A44B 19/308 24/424
5,604,962 A 2/1997 Mayerhofer
5,611,121 A * 3/1997 Akeno ..... A44B 19/308 24/419
5,625,928 A * 5/1997 Terada ..... A44B 19/308 24/421
5,664,300 A * 9/1997 Mizuno ..... A44B 19/308 24/421
5,694,667 A * 12/1997 Mizuno ..... A44B 19/306 24/421
5,698,243 A 12/1997 Wakabayashi
5,729,874 A * 3/1998 Mizuno ..... A44B 19/308 24/429
5,809,622 A * 9/1998 Yaguramaki ..... A44B 19/308 24/419
5,884,373 A * 3/1999 Kawamura ..... A44B 19/306 24/419
5,896,628 A * 4/1999 Oda ..... A44B 19/306 24/421
6,062,839 A 5/2000 Funaya
7,320,768 B2 1/2008 Eimura
2005/0086775 A1* 4/2005 Bernasconi ..... A44B 19/306 24/422
2007/0186392 A1 8/2007 Sewitch, Jr.
2013/0007994 A1 1/2013 Iannello et al.
2013/0174386 A1 7/2013 Koenigkramer
2013/0255042 A1* 10/2013 Keyaki ..... A44B 19/308 24/430
2013/0291350 A1 11/2013 Cowin et al.
2013/0312230 A1 11/2013 Chang et al.
2014/0082896 A1* 3/2014 Li ..... A44B 19/308 24/424
2015/0201716 A1 7/2015 Rojas et al.
2015/0203251 A1 7/2015 Anzini et al.

FOREIGN PATENT DOCUMENTS

CN 1105629 C 4/2003
GB 2220608 1/1990
GB 2289917 12/1995

* cited by examiner

METAL ONE PIECE LOCKING SLIDE AND PULL FOR SLIDE FASTENER

PRIORITY CLAIM

In accordance with 37 C.F.R. 1.76, a claim of priority is included in an Application Data Sheet filed concurrently herewith. Accordingly, the present invention also claims priority as a Continuation-in-Part of U.S. application Ser. No. 15/385,000, entitled "Metal One Piece Slide and Pull for Slide Fastener" filed Dec. 20, 2016, the contents of which is incorporated herein by reference.

FIELD OF INVENTION

The present invention generally relates to slide fasteners, commonly referred to as zippers, and more particularly to a one piece locking slider and pull made from metal for the slide fastener.

BACKGROUND INFORMATION

A zipper, zip, fly or zip fastener, formerly known as a clasp locker or slide fastener, is a commonly used device for binding the edges of an opening of fabric or other flexible material, like on a garment or a bag. It is used in clothing (e.g., jackets and jeans), luggage and other bags, sporting goods, camping gear, and other items.

The bulk of a zipper/zip consists of two rows of protruding teeth, which may be made to interdigitate, linking the rows, carrying from tens to hundreds of specially shaped metal or plastic teeth. These teeth can be either individual or shaped from a continuous coil, and are also referred to as elements. The slider, operated by hand, moves along the rows of teeth. Inside the slider is a Y-shaped channel that meshes together or separates the opposing rows of teeth, depending on the direction of the slider's movement.

In general, a zipper represents a small amount of the overall cost of a product. However, if it fails, the entire garment or device may be unusable until the zipper is replaced or repaired. Problems often lie with the slider portion of the zipper. Sliders are typically made of a slide portion and a pull. The user grabs the pull, which is pivotally connected to the slide, and pushes or pulls the slide in one direction or the other to cause the slide to move. Movement of the slide causes the teeth to engage or disengage with each other as the movement occurs. Slides are typically manufactured to include one or more pieces to which the pull is later assembled. Assembly of the pull to the slide is usually accomplished by bending a bridge portion of the slide which is die cast having a gap to create an interlocking engagement between the two components. Another method involves bending a portion of the pull around a solid bridge. Still other methods require assembly of extra bridge components which may be bent, staked or otherwise secured to the slide. However, these constructions are weak and prone to breakage with repeated use, causing the pull to become separated from the slide.

It has been proposed in the past to form the slide and the pull in a single operation. However, the proposed methods, devices and resulting zipper products have been unable to be produced or are unacceptable to the industry when produced from metal. Producing a metal slider assembly with the pull interlocked with the bridge has proven to be extremely difficult due to the rigid properties of the metal, which makes tool retraction from around the formed part very difficult without modifying the geometry of the part in an undesirable manner.

For example, U.S. Pat. No. 2,736,062 to Scheuermann et al. discloses a method of molding a slide and pull together in a single operation. Scheuermann utilizes four slides that intersect at 45 degree angles with respect to each other. The slides intersect at the bridge and pull portions of the slider assembly with the pull positioned at a vertical right angle with respect to the top surface of the slide. However, this method, as shown in the drawings, requires the inner surfaces of the pull loop and the bridge to include 45 degree or similar angles that form sharp points along the inner surfaces. The sharp points cause stress risers in the part, and the sharp corners wear very quickly, causing any surface coatings to be worn away. This results in discoloration of the slide assembly and often results in corrosion of the parts during a washing cycle. In addition, the modified geometry severely limits the movement of the pull within the bridge by reducing the space that the pull has to rotate and slide within the bridge.

U.S. Pat. No. 5,604,962 to Mayerhofer, U.S. Pat. No. 5,698,243 to Wakabayashi, U.S. Pat. No. 4,210,196 to Weiner, and U.K. Patent No. 2,220,608 to Liso all show variations of the Scheuermann device, which all require the angles inside of the bridge and the pull to retract the tools. Even though the angles are not depicted in all of the patents, the tooling cannot be retracted through hardened metal, and thus must be there for the tooling to function.

U.S. Pat. No. 2,509,278 to Scheuermann et al. discloses a mold that rotates the pull about its vertical axis to try and eliminate the angles on the inner surface of the pull loop. However, the angles are still required on the inner surface of the bridge, and the difficulty in producing the tools with the precision required for the pull rotation about the vertical axis has proven too costly.

U.S. Pat. No. 4,790,973 to Minami et al. discloses a different method and device for molding slider assemblies. Minami molds the slide first and, once the slide has solidified, a core is partially retracted to form the pull in a secondary molding operation while the slide is still positioned in the mold.

U.S. Pat. No. 5,013,511 to Akashi discloses yet another method and device for forming a zipper slide from metal. Akashi, like Minami, forms the slide portion in a first operation and forms the pull in a secondary operation. However, the pull of Akashi includes a pin which engages the bridge of the slide instead of the loop as disclosed in other prior art.

U.S. Pat. No. 4,985,969 to Terada et al. discloses yet another method and device for forming a zipper slide assembly. Terada forms the pull in combination with an intermediate pull portion with the two portions interlocked with a pin member that is formed within a mold as a secondary operation.

U.K. Patent Application No. 2,289,917 to YKK Corp. discloses a locking slider assembly. The YKK locking slider discloses forming the pull in a separate mold and placing the pull in a secondary mold where the slide is formed around a pin portion of the pull to complete the assembly.

Thus, a need in the art exists for a device and method of forming a slide in combination with a pull, wherein the slide and pull can be formed from metal without the need for modified geometry of the slide assembly, including internal angled surfaces in the bridge and the loop portion of the pull.

The slide should include a locking mechanism that interacts with the zipper chain to prevent unwanted opening of the slide fastener.

The combined locking slide and pull assembly should satisfy the ergonomic needs that a locking zipper slide assembly must satisfy in order to achieve acceptance by the end user. This includes providing a locking mechanism that is positioned within the slide bridge which includes an internal surface geometry that allows free movement and rotation of the pull. Further, the locking zipper slide assembly should not require excessive strength to operate or include oversized or pivoting component parts. Moreover, the locking zipper slide assembly must assemble together in such a way so as not to detract from the aesthetic appearance of the completed zipper assembly or garment assembly.

Thus, the present invention provides a die cast locking zipper slide assembly formed in a single operation which overcomes the disadvantages of prior art zipper slide assemblies formed in one or multiple operations. The locking zipper slide assembly of the present invention not only provides for relative ease in manufacturing, it also permits slides and pulls to be manufactured together without the need to put motion limiting and failure prone angles on the inner surfaces of the bridge and pull loop. The present invention places a locking member within the one piece interconnected bridge. The present invention also provides a manufacturing method which utilizes at least one side shifting slide, thereby eliminating the need for slides that interlock at angles and require the part geometry to be modified to accommodate the slide angles. The slide includes a lock assembly that interacts with the zipper chain to prevent unwanted opening of the slide fastener. The locking member of the lock assembly is releasable by movement of the pull member and should automatically reset upon release of the pull. The locking mechanism should also allow the slide to be freely moved to the interlocked position without resistance and prevent movement to a non-interlocked position without causing the pull to release the locking member from the zipper teeth.

SUMMARY OF THE INVENTION

Briefly, the invention involves a locking slider assembly for a zipper and method for manufacturing a zipper slide assembly. The slider assembly is formed in a single die cast operation to include the slider and the pull being formed simultaneously. At least one side shifting slide is incorporated into the die, which allows the bridge and pull loop to be formed with their full geometric shape and without the converging flat surfaces required in the prior art. A locking member is assembled to the slide to fit within a preformed channel that extends longitudinally through the bridge. The locking member is constructed and arranged to automatically engage the zipper teeth as the slide is moved to interlock the teeth. The locking member is easily disengaged from the zipper teeth by moving the pull to the second end of the bridge and applying a small force to the pull member.

Accordingly, it is an objective of the present invention to provide a locking slider assembly for a zipper that includes a locking slide and a pull and is formed from metal in one operation.

It is a further objective of the present invention to provide a locking slider assembly including a slide and a pull that is die cast to include its full geometry without the need for converging inner surfaces.

It is yet a further objective of the present invention to provide a locking slider assembly for a zipper that includes a closed pull loop and a closed bridge on the slide.

It is another objective of the present invention to provide a method of manufacturing a locking slider assembly for a zipper that includes a longitudinally positioned channel extending through the bridge for positioning of the locking member.

It is yet another objective of the present invention to provide a method of manufacturing a locking slider assembly for a zipper that includes two or more side shifting slides for shifting the slide portions of the tool around solidified part geometry.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
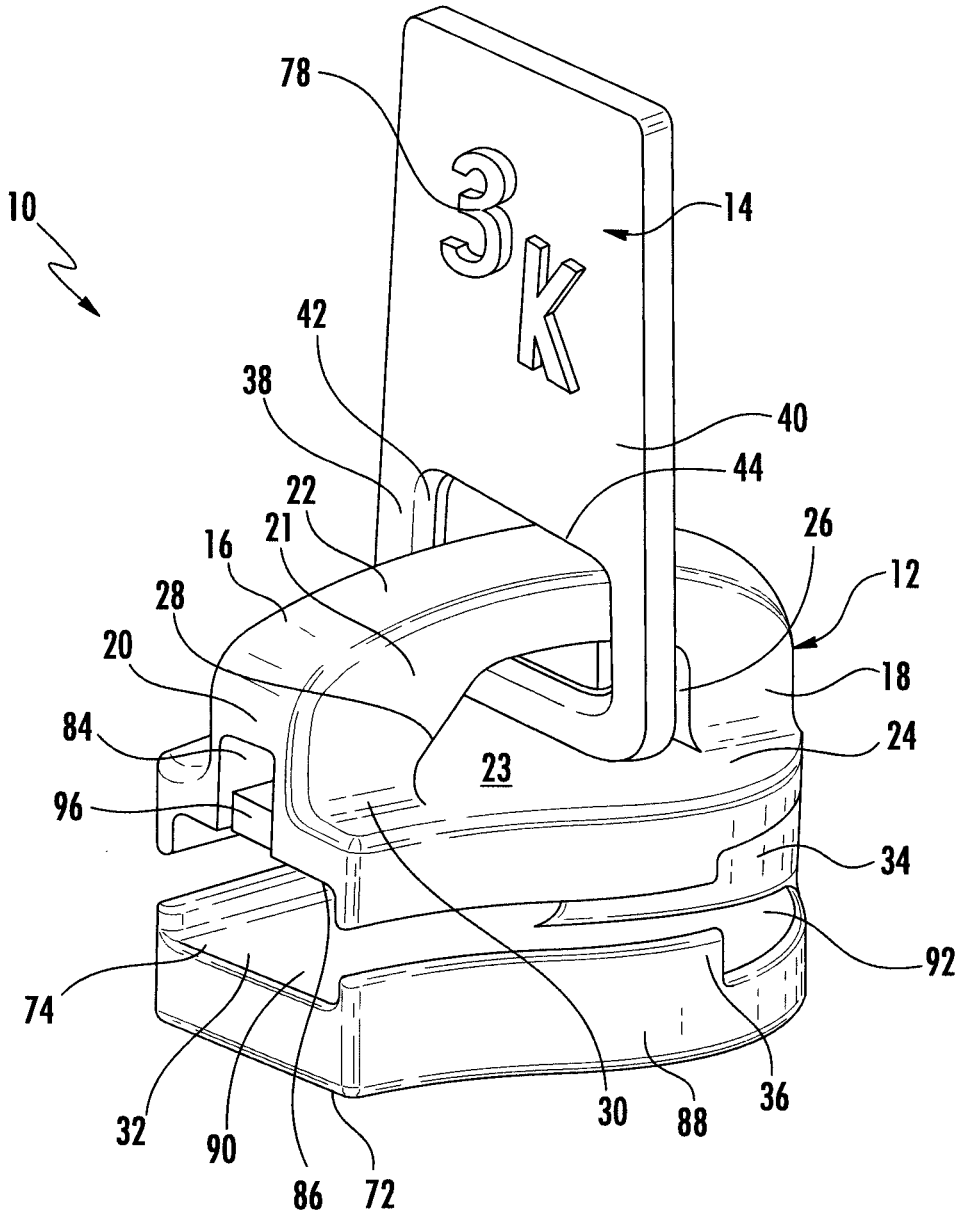
FIG. 1 is a top isometric view of one embodiment of the present invention, illustrating the preferred position for die casting of the slider assembly.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
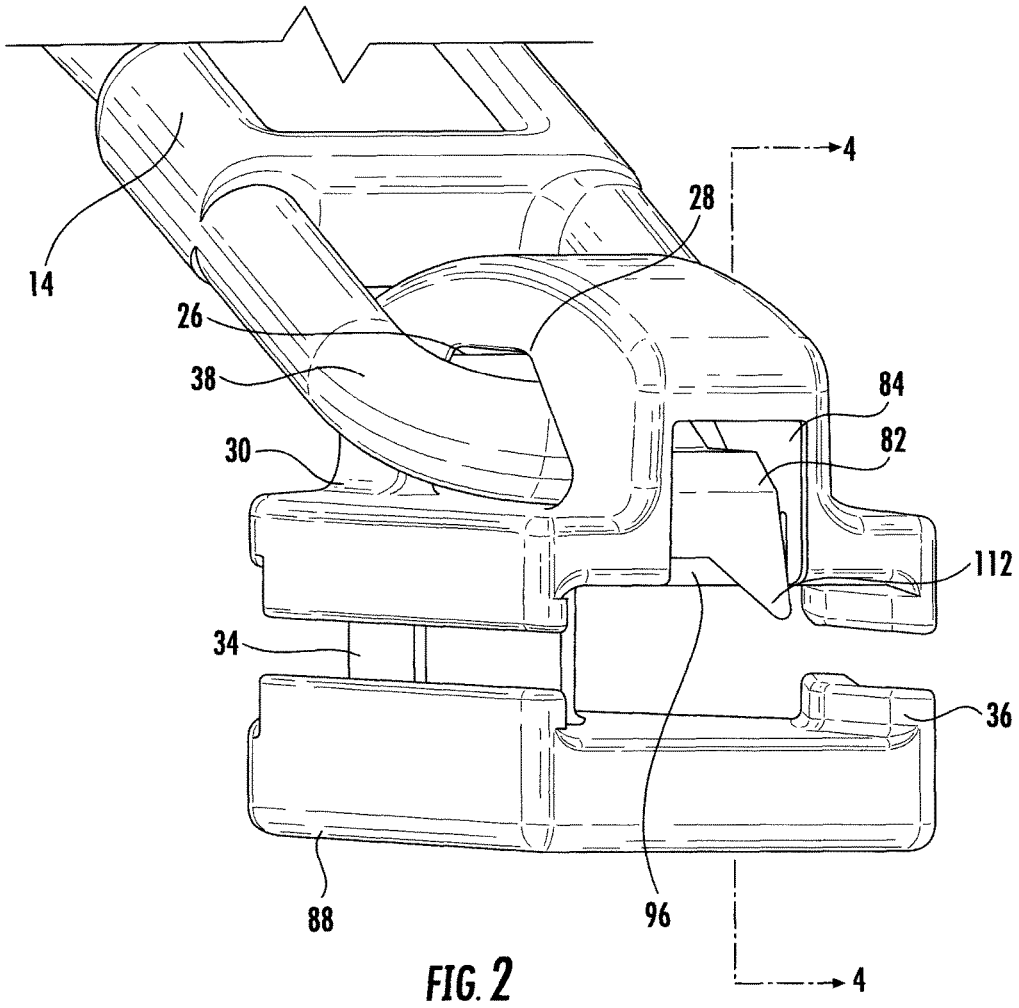
FIG. 2 is a partial rear isometric view of the embodiment shown in FIG. 1 illustrating a slider pull that has a round cross section in the area of the bridge and a locking member.
Figure 3:
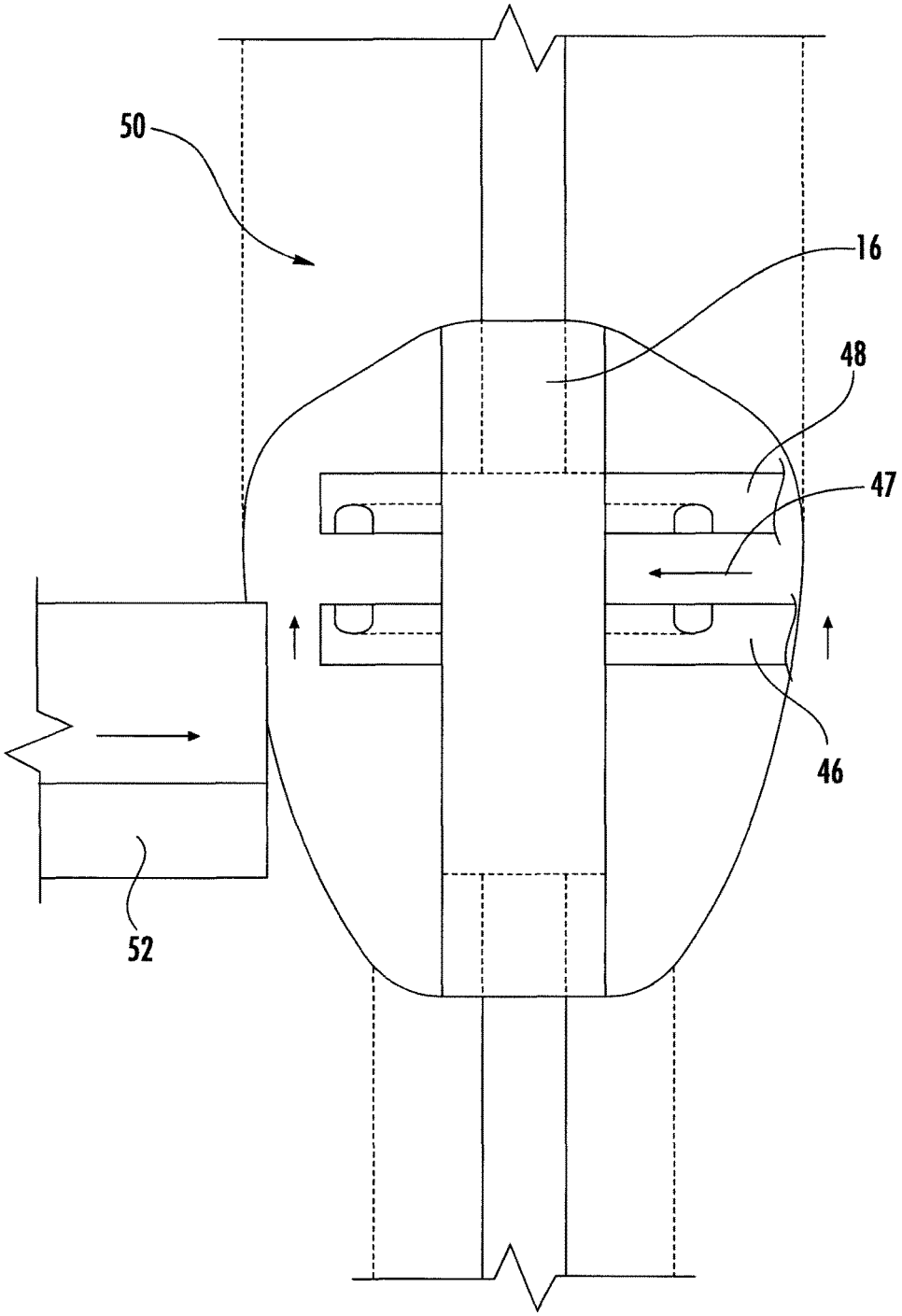
FIG. 3 is a partial top view of the embodiment shown in FIG. 1 illustrating the closing of the die casting tool having at least one side shifting slide.
Figure 4:
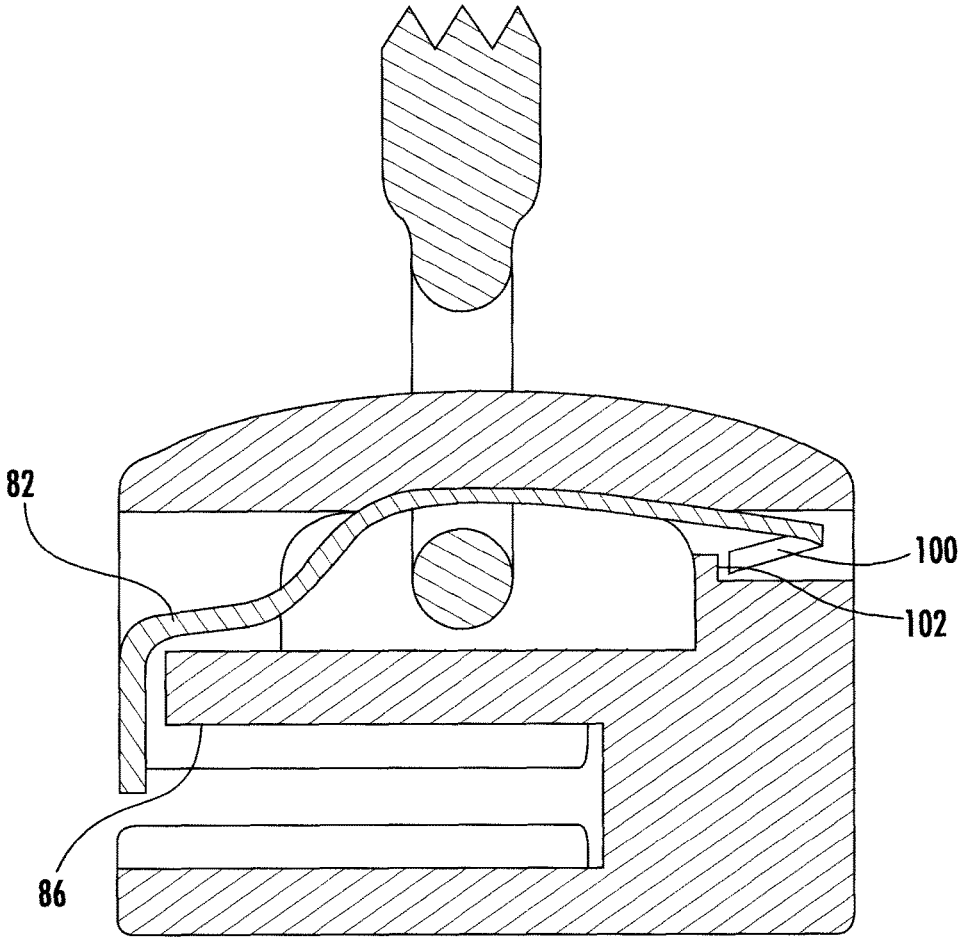
FIG. 4 is a section view taken along lines 4-4 of FIG. 2 illustrating one embodiment of a locking member extending through the bridge of the slide.
Figure 5C:
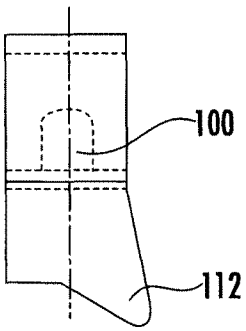
FIG. 5C is an end view of the locking member illustrated in FIG. 5A.
Figure 5A:
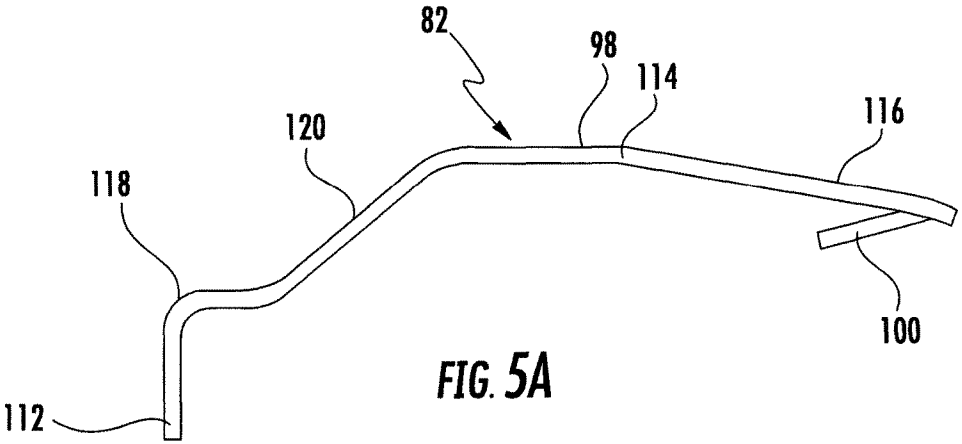
FIG. 5A is a side view of one embodiment of a locking member for locking the slider assembly in position on a zipper chain.
Figure 5B:
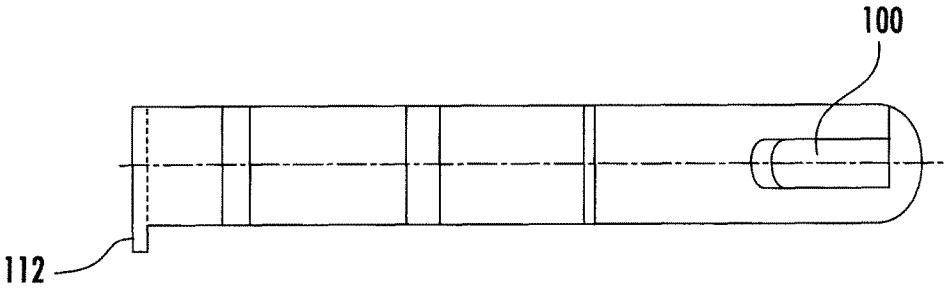
FIG. 5B is a top view of the locking member illustrated in FIG. 5A.

Referring generally to FIGS. 1-3, a locking slide assembly (10) for zippers is illustrated. In its simplest form, the locking slide assembly (10) includes a slide member (12) and a pull member (14). The locking slide assembly (10) is preferably formed during a single operation in a die cast machine (not shown). The slide member (12) is formed to include a bridge (16) for locating and retaining the pull member (14) in a manner that allows for rotation and some linear translation of the pull member (14). The bridge (16) is also formed so that it does not include breaks or gaps which could weaken the bridge (16) and allow the pull member (14) to be released. Particularly, the bridge (16) includes a first end (18), a second end (20), and a central portion (22) having a pair of bridge side surfaces (21) all integrally formed together as a single and continuous integral piece. Both the first and second ends (18) (20) of the bridge (16) are integrally formed to the slide top (23) having a top surface (24). The slide top (23) and a slide bottom (88) being separated and secured together with a splitter (34). The splitter (34) divides the inner portion (32) into the Y-shape for causing the zipper chain (94) to be joined or separated as is known in the art. The slide top (23) includes a top surface (24) and a lower first guiding surface (86) along with a pair of guide wall(s) (36) integrally formed as part of the slide top forming the upper guide (72). The slide bottom (88) includes a second upper guiding surface (90) along with a pair of guide wall(s) (36) integrally formed as part of the slide bottom (88) forming the lower guide (74). Together, the splitter (34) and guides (72) (74) are constructed and arranged to interlock the zipper chain (94) when moved in a first direction, and disengage the zipper chain (94) when moved in a second direction.

Referring to FIGS. 2, 4 and 5A-B of the preferred embodiment, the bridge (16) includes a locking member (82)(FIG. 2) that extends into the Y-shaped channel (92) for engaging a portion of a zipper chain (94) to resist unwanted movement of the slide member (12) with respect to the zipper chain (94). An inner surface (26) of the bridge is formed to be substantially flat as it extends transversely from side to side of the slide, but may include any desirable longitudinal contour for function or aesthetics. Thus, the locking member (82) is formed to conform to the contours of the inner surface of the bridge with a portion of the locking member (82) being formed to allow the pull member (14) to retract the catch (112) of the locking member (82) from engagement with the zipper chain (94). Because the bridge is integrally formed, corner radii (28) and fillets (30) may be formed during the die casting process to add strength and rigidity to the structure, as well as aesthetic appearance.

Referring to FIGS. 1-6 of one embodiment, the second end (20) of the bridge (16) includes a locking member bore (84). The locking member bore (84) includes a locking member channel (96) for passage of a portion of the locking member (82) from the bridge into said Y-shaped channel (92). The locking member bore (84) preferably extends through the second end (20) of the bridge (16) and the first end (18) of the bridge (16) so that the locking member (82) can extend through the locking member bore (84) at the second end (20) of the bridge (16) and into the locking member bore (84) at the first end (18) of the bridge (16)(see FIG. 4). In this manner, the locking member (82) may include a catch (100) constructed and arranged to interlock with a catch surface (102) positioned within the bridge (16), the catch (100) and catch surface (102) cooperating to position and retain the locking member (82). In one embodiment, the locking member (82) is constructed from a spring tempered, or other high resilience material to include an arch portion (98); the arch portion (98) extending over the loop portion (38) of the pull member (14), whereby movement of the pull member (14) in a predetermined direction retracts the catch (112) of the locking member (82) from the Y-shaped channel (92), allowing the zipper chain (94) to move freely through the channel.

Referring to FIGS. 1, 2, 5A, 5B and 5C, one embodiment of a locking member (82) is illustrated. The locking member (82) includes a length sufficient to extend between the first end (18) of the bridge and the second end (20) of the bridge, and a contoured central portion (114) having curvature to lie closely to the inner surface (26) of the bridge (16). The front portion (116) of the locking member (82) includes the locking member catch (100) which retains and positions the locking member (82) within the bridge (16). In this non-limiting embodiment, the locking member catch (100) is formed as a partial perforation of the locking member (82). This construction allows the front portion (116) to be inserted through the locking member channel (104) whereby the locking member catch (100) may spring past the catch surface (102), retaining the locking member in a proper position. The rear portion (118) of the locking member (82) includes the locking member catch (112) which extends into the Y-shaped channel (92) to engage a portion of the zipper chain teeth. In the preferred embodiment, the locking member catch (112) engages one side of the zipper chain (94). However, the locking member catch (112) may engage any portion of the zipper chain (94) or the webbing that supports the zipper chain (94) without departing from the scope of the invention. It should also be noted that an unlatching portion (120) of the locking member (82) is formed to be separated from the inner surface (26) of the bridge (16) in its normal state. In this manner, the pull (14) may be utilized to displace this portion of the locking member to retract the locking member catch (112) from the Y-shaped channel (92). Movement of the pull (14) thereby releases the locking member (82) to engage the zipper teeth. It should also be noted that this construction allows the locking member (82) to be moved in the direction of engaging the zipper chain (94) with the need to retract the locking member (82) from the Y-shaped channel (92), but will not allow the slide to be moved to disengage the zipper chain (94) without retraction. It should also be noted that while this locking member is illustrated as being flat or a leaf type spring member, other shapes suitable for providing the described function may be utilized without departing from the scope of the invention.

It should be noted that, the pull (14) is formed in position around the bridge (16) to include a loop portion (38). The loop portion is integrally formed to the first tab portion (40) to eliminate breakage and separation of the two components during use. The loop portion (38) may include any geometry desirable, which may include rounds, ovals, polygons and the like. The present method of manufacturing provides that the geometry is complete and does not require converging flat surfaces that are required to remove the tools from the formed part during manufacturing as seen in the prior art. In the embodiment illustrated in FIG. 1, the loop portion (38) is formed to be square in cross section, having a substantially flat inner loop surface (42) with inner corners (44) providing the desired appearance and function to the overall slide assembly (10). FIG. 2 illustrates a slide assembly (10) having a loop portion (38) with a round cross section formed around the same or similar bridge construction as described in FIG. 1. In this embodiment, the loop geometry is formed complete and does not require relief geometry for the tooling retraction after forming.

Figure 6:
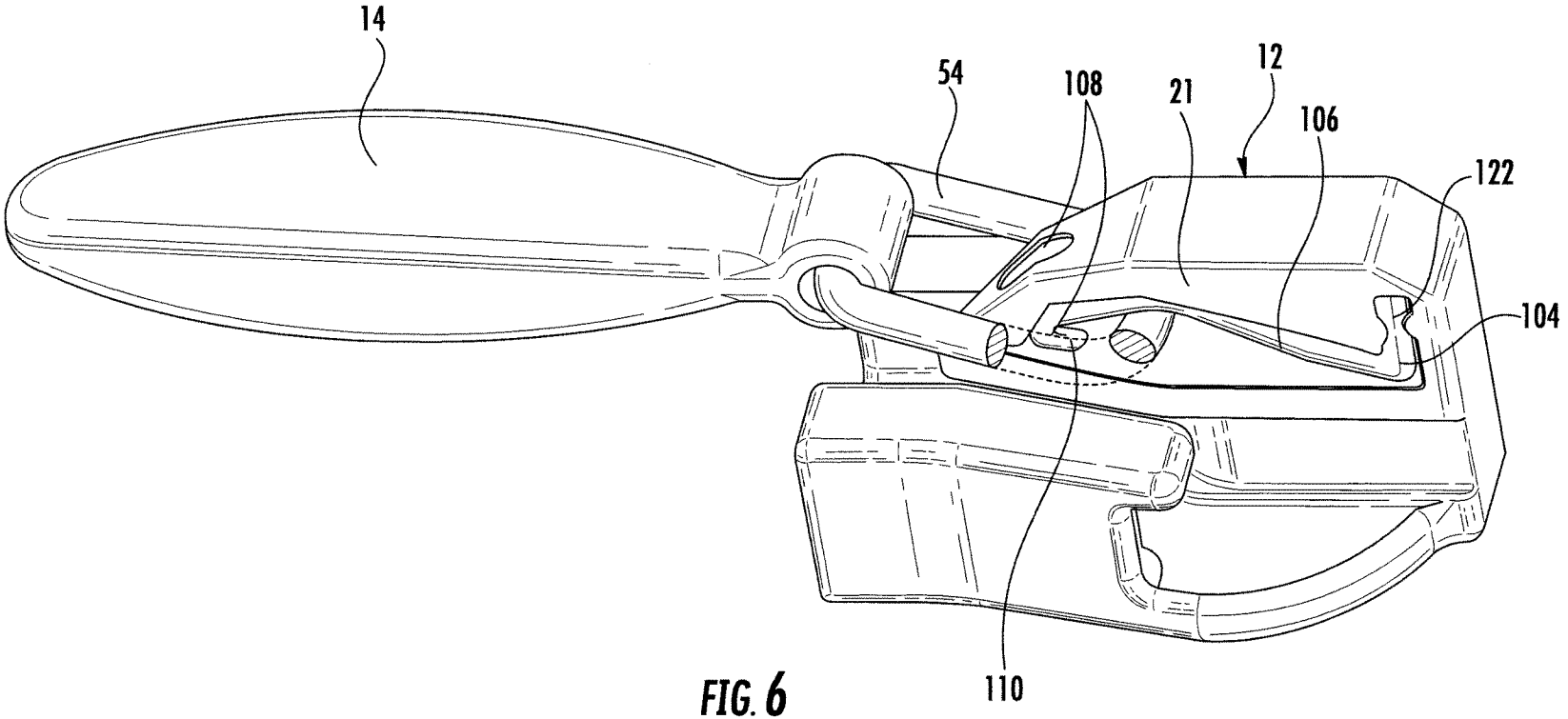
FIG. 6 is an isometric view of an alternative embodiment of a locking slide assembly illustrating an additional link formed between the slide and the pull of the slider assembly and an alternative locking member.
Figure 7:
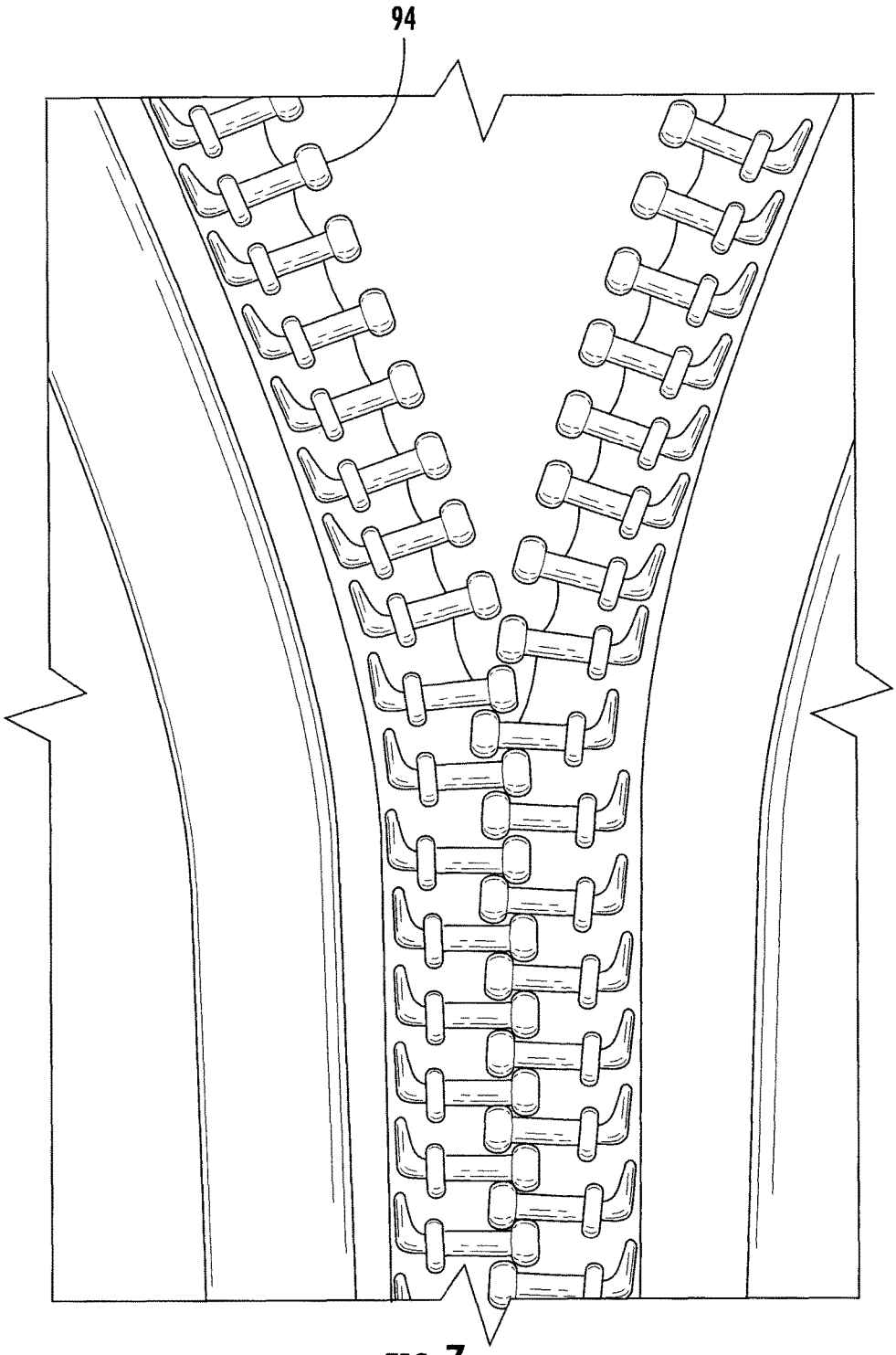
FIG. 7 is one embodiment of a zipper chain.

Referring to FIG. 6, an alternative embodiment of the locking slide assembly (10) is illustrated. In this embodiment, one of said side surfaces (21) of the bridge (16) is formed to include a locking member channel (104) at the first end of the bridge (16). The locking member channel (104) has sufficient width and depth for locating a first end (122) of a round locking member (106) extending from said bridge side surface (21) so that a second end (108) of the round locking member (106) extends into said Y-shaped channel (92) for engaging a portion of said zipper chain (94). In at least one embodiment, the second end (108) of the locking member (106) extends through a vertical bore (110) extending through said slide top (23) into said Y-shaped channel (92); the vertical bore (110) being formed during formation of the slide and pull. Thus, the locking member (106) may be formed of wire, flat material, or any other desirable shaped material without departing from the scope of the invention.

Referring to FIG. 1-6, the pull member (14) is formed in position around the bridge (16) to include a loop portion (38). The loop portion (38) is integrally formed to the first tab portion (40) to eliminate breakage and separation of the two components during use. The loop portion (38) may include any geometry desirable, which may include rounds, ovals, polygons and the like, so long as the geometry is complete and does not require converging flat surfaces that are required to remove the tools from the formed part during manufacturing as seen in the non-locking slider prior art. In the embodiment illustrated in FIG. 1, the loop portion (38) is formed to be square in cross section, having a substantially flat inner loop surface (42) with inner corners (44) providing the desired appearance and function to the overall slide assembly (10). FIG. 2 illustrates a slide assembly (10) having a loop portion (38) with a round cross section formed around the same or similar bridge construction as described in FIG. 1. In this embodiment, the loop geometry is formed complete and does not require relief geometry for the tooling retraction after forming.

FIG. 3 illustrates one embodiment for forming the pull (14) in place around the bridge (16). As illustrated, the tool includes at least one side shifting slide (46). As the die casting tool (50) is closed to form a slide (12) and pull (14), the at least one side shifting slide (46) and at least one first insert (48) and one secondary insert (52) are inserted into the area under the bridge (16). The insert (48) and side shifting insert (46) are positioned first along an insertion path so that the side shift can occur after the slide has reached its insertion depth. Next, the secondary insert (52) is timed to be positioned in the die casting tool (50) adjacent to the side shift insert (46) once the side shift has occurred. The remaining portions of the mold can be closed before, after or simultaneously with the slides without departing from the scope of the invention. Other portions of the mold include mold sections that form the remainder of the loop (38) and pull (14). In a most preferred embodiment, the pull (14) is positioned to stand vertically with respect to the slide as illustrated in FIG. 1. However, it should be noted that by utilizing the side shifting slide(s), the pull (14) may be rotated to different angles as needed in the mold without departing from the scope of the invention. After formation of the slide assembly (10) in the die cast mold, the at least one side shifting slide (46) is configured to make an orthogonal side shift after formation of the slide assembly, the side shift having a length great enough to clear the geometry of the loop portion (38) before retraction of the slide from under the bridge (16).

Referring to FIG. 6, a slide assembly (10) further including a connecting link (54) positioned and formed between the pull member (14) and the slide member (12) is illustrated. The connecting link (54) is formed as a continuous member, extending around the bridge (16) and the loop (38), connecting the bridge (16) to the pull member (14). The connecting link (54) is formed using the side shifting slides (46) in the same manner as the loop portion (38) of the pull (14).

Referring to FIGS. 1-6, it should be noted that the pulls (14) or slides (12) may include indicia (78) which may include, but should not be limited to, logos, figures, characters, serial numbers, lot numbers, part numbers, patent numbers, trademarks and the like that are integrally formed as part of the slide assembly (10). Specifically, the logos, figures or characters may be formed on any surface of the puller or slide. This provides a significant advantage over other methods of manufacture. It should also be noted that the present embodiments are specifically utilized for forming slide assemblies from metal in a die casting process, and thus various metals may be utilized, including, but not limited to, titanium, zinc, aluminum, magnesium, copper, brass and suitable combinations thereof.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention, and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A locking slide assembly for a zipper comprising:

a slide member (12), said slide member (12) being constructed and arranged to open and close a zipper chain (94), said slide member (12) including a slide top (23), said slide top (23) having a top surface (24) and a lower guiding surface (86), a slide bottom (88) having a bottom surface (25) and an upper guiding surface (90), said slide top (23) and said slide bottom (88) separated by an integrally formed splitter (34) to form a Y-shaped channel (92) between said slide top (23) and said slide bottom (88) for guiding said zipper chain (94) therethrough, said splitter integrally formed to a bottom surface of said upper guide and a top surface of said lower guide such that said slide member is a single piece, said top surface (24) including a bridge (16) having a first end (18) and a second end (20) said bridge integrally formed to said top surface (24) as a continuous member not having breaks along the length of said bridge, a bridge inner surface (26) defining an opening between said bridge (16) and said top surface (24) of said slide member (12) for through passage of a loop portion of a metal pull member (14), and a pair of bridge side surfaces (21), said bridge (16) including an insertable locking member (82) extending into said Y-shaped channel (92) for engaging a portion of said zipper chain (94) to resist unwanted movement of said slide member (12) with respect to said zipper chain (94);

said pull member (14) constructed from metal and having a loop portion (38) and a first tab portion (40), said loop portion (38) formed as a continuous unbroken loop around said bridge (16) and integrally formed to said first tab portion (40), said pull member (14) being movable to disengage said locking member (82) from said zipper chain (94) to provide free movement of said slide member (12);

said slide member (12) and said pull member (14) both formed of metal to be continuous and unbroken, said pull member (14) being freely moveable with respect to said slide member (12).

2. The locking slide assembly of claim 1 wherein said second end (20) of said bridge (16) includes a locking member bore (84), said locking member bore (84) including a locking member channel (96) for passage of a portion of said locking member (82) from said bridge (16) into said Y-shaped channel (92).

3. The locking slide assembly of claim 2 wherein said locking member is constructed from a spring tempered material.

4. The locking slide assembly of claim 3 wherein said locking member bore (84) extends through said second end (20) of said bridge (16) and said first end (18) of said bridge (16), said locking member (82) extending through said locking member bore (84) at said second end (20) of said bridge (16) and into said locking member bore (84) at said first end (18) of said bridge (16).

5. The locking slide assembly of claim 4 wherein said locking member (82) includes an arch portion (98), said arch portion (98) extending over said loop portion (38) of said pull member (14), whereby movement of said pull member (14) in a predetermined direction retracts said locking member (82) from said Y-shaped channel (92).

6. The locking slide assembly of claim 4 wherein said locking member (82) includes a catch (100), said locking member catch (100) constructed and arranged to interlock with a catch surface (102) positioned within said bridge (16), said catch and said catch surface cooperating to position and retain said locking member (82).

7. The locking slide assembly of claim 1 wherein one of said side surfaces (21) of said bridge (16) includes a locking member channel (104), said locking member channel (104) having sufficient width and depth for locating a first end (122) of said locking member (106) extending from said bridge side surface (21) so that a second end (108) of said locking member (106) extends into said Y-shaped channel (92) for engaging a portion of said zipper chain.

8. The locking slide assembly of claim 7 wherein said second end (108) of said locking member (106) extends through a vertical bore (110) extending through said slide top (23) into said Y-shaped channel (92).

9. The locking slide assembly of claim 7 wherein said locking member (106) is constructed from spring tempered wire.

10. The locking slide assembly for a zipper of claim 7 wherein said locking slide assembly (10) further includes a metal connecting link (54) positioned and formed between said pull member (14) and said slide member (12), said connecting link (54) formed as a continuous unbroken member extending around said bridge (16) and said loop portion (38) connecting said bridge (16) to said pull member (14).

11. The locking slide assembly for a zipper of claim 1 wherein said inner surface (26) of said bridge (16) is formed to be substantially flat and substantially parallel with respect to said top surface (24) of said slide member as it extends transversely across said bridge (16).

12. The locking slide assembly of claim 2 wherein said locking member is constructed from a resilient material.

13. The slide assembly of claim 1 wherein said pull member (14) includes indicia (78) formed integrally thereon, said indicia formed during die casting process.

14. The slide assembly of claim 1 wherein said slide member (12) includes indicia (78) formed integrally thereon, said indicia formed during die casting process.

15. The slide assembly for a zipper of claim 1 wherein said loop portion (38) of said pull member (14) is substantially round.

16. The slide assembly for a zipper of claim 1 wherein said loop portion (38) of said pull member (14) is polygon shaped.

* * * * *